US010745885B2

(12) United States Patent
Stoops et al.

(10) Patent No.: US 10,745,885 B2
(45) Date of Patent: Aug. 18, 2020

(54) SYSTEM FOR OPERATING A CIRCLE DRIVE GEAR OF A MACHINE

(71) Applicant: Caterpillar Inc., Peoria, IL (US)

(72) Inventors: Ernest Everett Stoops, Decatur, IL (US); William Norbert O'Neill, Eureka, IL (US); Bruce Raymond Vahling, Urbana, IL (US)

(73) Assignee: Caterpillar Inc., Peoria, IL (US)

( * ) Notice: Subject to any disclaimer, the term of this patent is extended or adjusted under 35 U.S.C. 154(b) by 434 days.

(21) Appl. No.: 15/841,384

(22) Filed: Dec. 14, 2017

(65) Prior Publication Data

US 2019/0186101 A1 Jun. 20, 2019

(51) Int. Cl.

| | |
|---|---|
| ***E02F 3/76*** | (2006.01) |
| ***E02F 3/84*** | (2006.01) |
| ***F15B 11/10*** | (2006.01) |
| ***F15B 13/02*** | (2006.01) |
| ***E02F 9/20*** | (2006.01) |
| ***E02F 9/22*** | (2006.01) |
| *F15B 15/26* | (2006.01) |

(52) U.S. Cl.

CPC ..... *E02F 3/844* (2013.01); *E02F 9/2004* (2013.01); *E02F 9/22* (2013.01); *F15B 11/10* (2013.01); *F15B 13/025* (2013.01); *F15B 13/027* (2013.01); *F15B 15/262* (2013.01); *F15B 2211/30505* (2013.01); *F15B 2211/40507* (2013.01); *F15B 2211/50518* (2013.01); *F15B 2211/5159* (2013.01); *F15B 2211/55* (2013.01); *F15B 2211/7058* (2013.01); *F15B 2211/715* (2013.01); *F15B 2211/7128* (2013.01)

(58) Field of Classification Search

CPC ..... E02F 3/764; E02F 3/7645; E02F 3/765; E02F 3/7654; E02F 3/844; E02F 3/7668; E02F 9/22; E02F 9/2004; F15B 11/10; F15B 13/025; F15B 13/027; F15B 15/262

USPC ..... 172/791, 792, 796

See application file for complete search history.

(56) References Cited

U.S. PATENT DOCUMENTS

| | | | | |
|---|---|---|---|---|
| 3,448,816 | A | 6/1969 | Beals et al. | |
| 3,819,018 | A | 6/1974 | Muller et al. | |
| 3,989,112 | A | 11/1976 | Cole et al. | |
| 7,874,377 | B1 | 1/2011 | Graeve | |
| 9,228,316 | B2 * | 1/2016 | Staade | E02F 3/7668 |
| 9,540,787 | B2 | 1/2017 | West et al. | |
| 2008/0229626 | A1 | 9/2008 | Bertoni | |

(Continued)

*Primary Examiner* — Robert E Pezzuto

(74) *Attorney, Agent, or Firm* — William R. Tinker

(57) ABSTRACT

A system for operating a circle drive gear of a machine includes a pump configured to output pressurized fluid, an implement control valve fluidly coupled to the pump, a bi-directional hydraulic motor located downstream of the implement control valve and fluidly coupled to the implement control valve via a first delivery line and a second delivery line. The hydraulic motor has an output shaft that is configured to be rotatively driven by pressurized fluid output by the pump. A brake is disposed on the output shaft of the hydraulic motor and engages with the output shaft with the help of a spring force for reducing a rotational speed of the output shaft in a brake engage state. The brake operatively disengages from the output shaft in a brake release state with the help of fluid pressure in at least one of the first delivery line and the second delivery line.

18 Claims, 5 Drawing Sheets

(56) References Cited

U.S. PATENT DOCUMENTS

| | | | | |
|---|---|---|---|---|
| 2012/0073890 | A1* | 3/2012 | Bindl | E02F 3/764<br>180/69.6 |
| 2016/0024750 | A1* | 1/2016 | Yoshimura | E02F 3/764<br>172/796 |

* cited by examiner

SYSTEM FOR OPERATING A CIRCLE DRIVE GEAR OF A MACHINE

TECHNICAL FIELD

The present disclosure generally relates to earthmoving machines. More particularly, the present disclosure relates to a system and method for operating a circle drive gear of an earthmoving machine e.g., a motor grader.

BACKGROUND

Numerous earthmoving machines are known to include a blade or a moldboard as their primary work implement for shaping or moving soil on a ground surface. An example of one such earthmoving machine may include a motor grader that is typically used for grading soil with the help of a moldboard. In some cases, during operation of the motor grader, the moldboard may impact with an immovable object, for example, a rock that is at least partially embedded within and protruding from the earth. The moldboard may consequently transmit the forces encountered during such impacts into a driving arrangement of the machine, for example, an output shaft of a hydraulic motor that is configured to rotatively drive a circle drive gear of the motor grader.

Given the speed of the machine and its momentum when travelling on the ground surface, these forces could cause failure of one or more components associated with the driving arrangement of the machine. Hence, it would be advantageous to provide a system that mitigates a susceptibility of components in the driving arrangement from being exposed to such forces when the moldboard encounters immovable objects in its path of travel.

SUMMARY OF THE DISCLOSURE

In an aspect of this disclosure, a system for operating a circle drive gear of a machine includes a pump, an implement control valve, a bi-directional hydraulic motor, and a brake. The pump is configured to output pressurized fluid therefrom. The implement control valve is fluidly coupled to the pump via a supply line. The bi-directional hydraulic motor is located downstream of the implement control valve and fluidly coupled to the implement control valve via a first delivery line and a second delivery line. The hydraulic motor has an output shaft associated therewith. The output shaft is configured to be rotatively driven by pressurized fluid output by the pump. The brake is disposed on the output shaft of the hydraulic motor. The brake is configured to engage with the output shaft with the help of a spring force for reducing a rotational speed of the output shaft in a brake engage state, and operatively disengage from the output shaft in a brake release state with the help of fluid pressure in at least one of the first delivery line and the second delivery line.

In another aspect of this disclosure, a machine includes a moldboard and a circle drive gear coupled to the moldboard. The machine also includes a pump, an implement control valve, a bi-directional hydraulic motor, and a brake. The pump is configured to output pressurized fluid therefrom. The implement control valve is fluidly coupled to the pump via a supply line. The bi-directional hydraulic motor located downstream of the implement control valve and fluidly coupled to the implement control valve via a first delivery line and a second delivery line. The hydraulic motor has an output shaft associated therewith. The output shaft is configured to be rotatively driven by pressurized fluid output by the pump. The brake is disposed on the output shaft of the hydraulic motor. The brake is configured to engage with the output shaft with the help of a spring force for reducing a rotational speed of the output shaft in a brake engage state, and operatively disengage from the output shaft in a brake release state with the help of fluid pressure in at least one of the first delivery line and the second delivery line.

In yet another aspect of this disclosure, a method for operating a circle drive gear associated with a moldboard of a machine includes providing fluid pressure from a pump via one of a first delivery line and a second delivery line to operatively drive an output shaft of a bi-directional hydraulic motor in which the output shaft has a brake that is disengaged from the output shaft by means of the fluid pressure in at least one of the first and second delivery lines. The method includes determining, by means of a controller, whether a command signal for rotating the output shaft of the hydraulic motor has been provided, and in response to determining that no command signal has been provided, the method further includes actuating the implement control valve, by means of the controller, such that the implement control valve operatively de-pressurizes the first and second delivery lines to facilitate the brake to engage with the output shaft of the hydraulic motor for providing a holding torque to the output shaft of the hydraulic motor.

Other features and aspects of this disclosure will be apparent from the following description and the accompanying drawings.

BRIEF DESCRIPTION OF THE DRAWINGS

The features and advantages of the present disclosure will become more apparent from the detailed description set forth below when taken in conjunction with the drawings.

DETAILED DESCRIPTION

Figure 1:
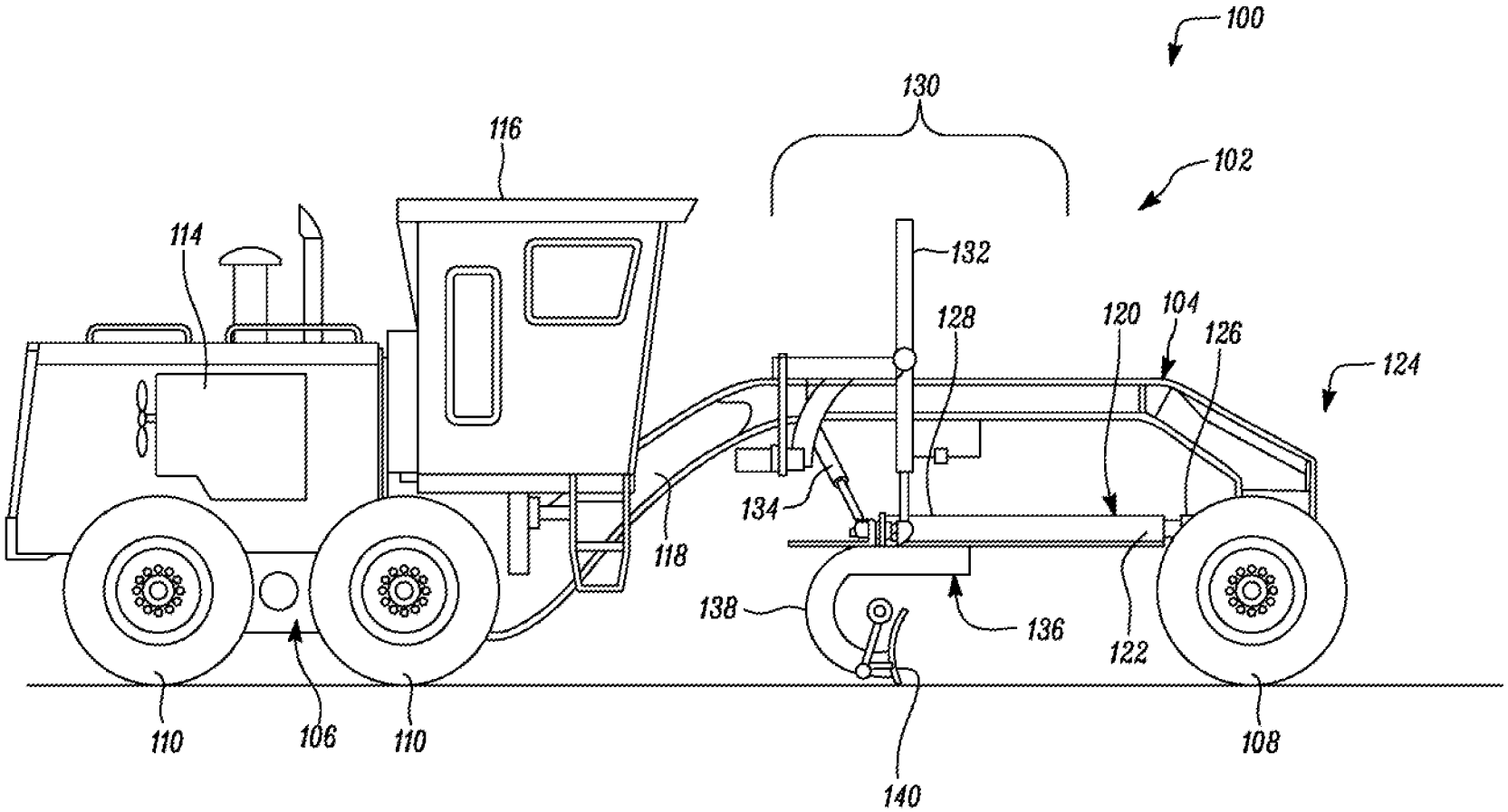
FIG. 1 is a diagrammatic side view of an exemplary machine having a moldboard, and a circle drive gear associated with the moldboard, in accordance with an embodiment of the present disclosure.

With reference to FIG. 1, an exemplary machine 100 is illustrated. As shown in the illustrated embodiment of FIG. 1, the machine is embodied as a motor grader 102. The motor grader 102 has a front frame 104 and a rear frame 106. The front frame 104 is supported on a pair of front wheels of which one front wheel 108 is visible in the side view of FIG. 1. The rear frame 106 is supported on a set of rear wheels of which two rear wheels 110, associated with a right side of the motor grader 102, are shown in the side view of FIG. 1.

Further, the front frame 104 is pivotally coupled to the rear frame 106 with the help of an articulation joint (not shown) to allow steering of the front frame 104 relative to the rear frame 106. Moreover, the rear frame 106 is configured to support a prime mover 114 thereon. The prime mover 114 disclosed herein may be, for example, an engine, a motor, or any other type of prime mover known to persons skilled in the art. An operator cab 116 is disposed on an inclined portion 118 of the front frame 104. The operator cab 116 is configured to house control levers, joysticks, push buttons, and other types of control elements typically known in the art for operating the motor grader 102.

The motor grader 102 also includes a drawbar 120 having a first end 122 that is coupled to an aft portion 124 of the front frame 104 with the help of a rotatable joint 126, for example, a ball and socket joint. A second end 128 of the drawbar 120 is coupled to a mid-portion 130 of the front frame 104 with the help of actuators 132, 134. The drawbar 120 is configured to rotatably support a circle drive gear 136 thereon. A portion 138 of the circle drive gear 136 extends downwardly to pivotally support a moldboard 140 thereon.

Figure 2:
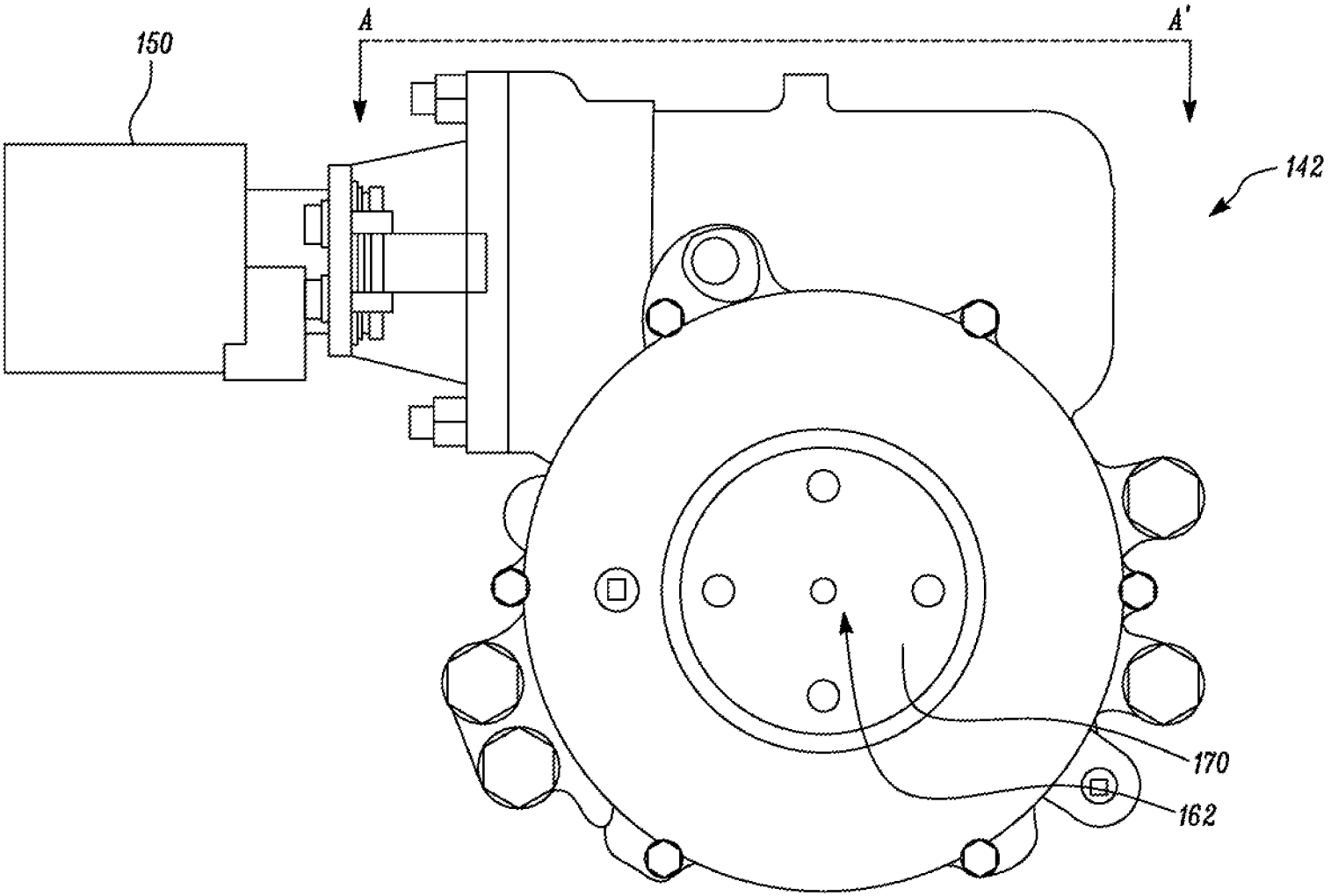
FIG. 2 is a side view of a system for operating the circle drive gear of the exemplary machine, in accordance with an embodiment of the present disclosure.
Figure 3:
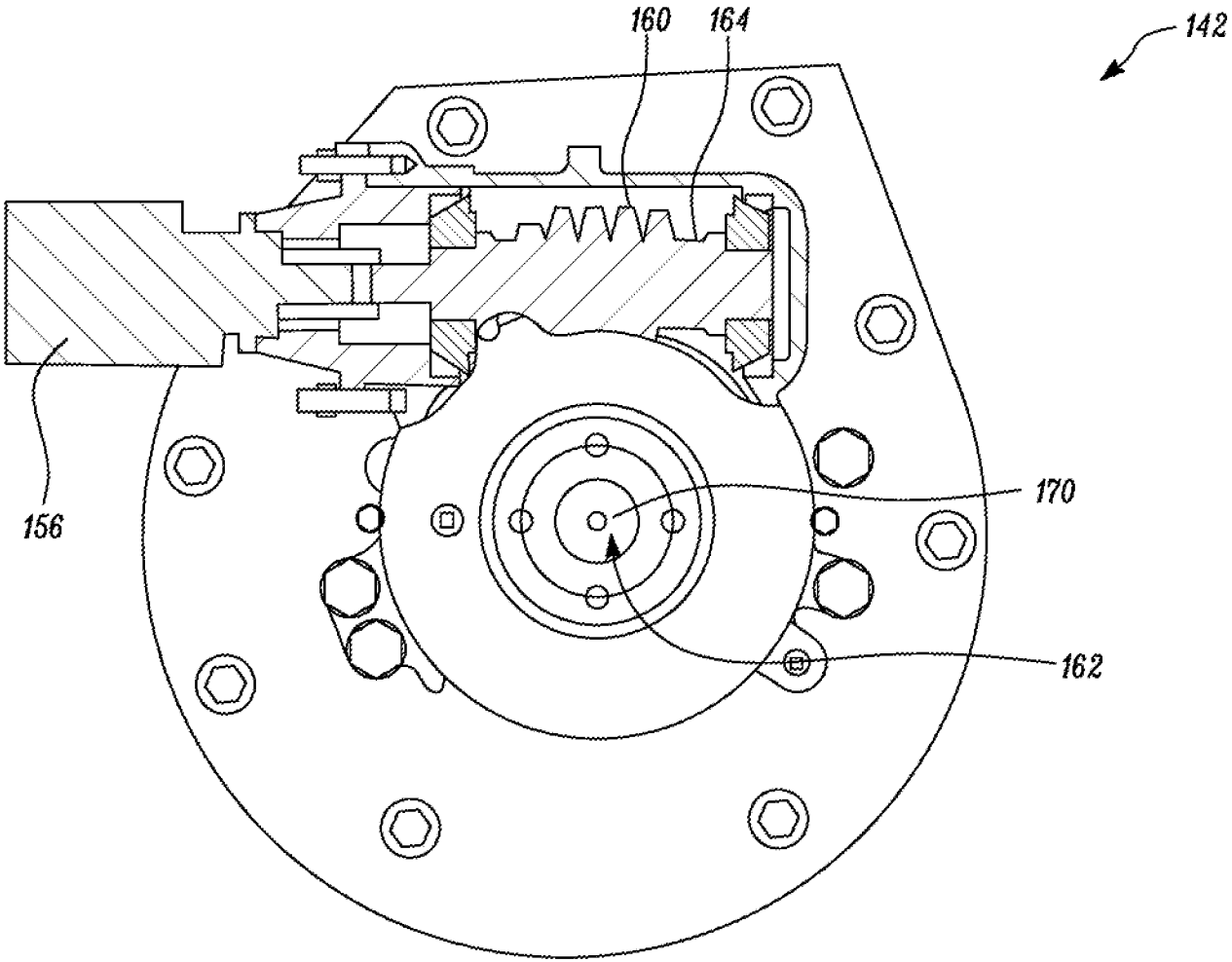
FIG. 3 is a zoomed-in partially fragmented side view of the system taken along section line A-A' of FIG. 2, in accordance with an embodiment of the present disclosure.

As shown in FIG. 2, a system 142 is provided to rotate the circle drive gear 136 depicted in FIG. 1. Also, FIG. 3 depicts a zoomed-in partially fragmented side view of the system 142 taken along section line A-A' of FIG. 2 while FIG. 4 schematically depicts an arrangement of components that form, at least in part, the system 142 for operating the circle drive gear 136 of the motor grader 102.

The drawbar 120, the circle drive gear 136, and the moldboard 140 can be caused to move in a number of directions. For instance, operation of the system 142 disclosed herein may rotate the circle drive gear 136 and cause the moldboard 140 to move in a clockwise or counterclockwise direction. Additionally, operation of the actuators 132 may cause the drawbar 120 and hence, the circle drive gear 136 to be raised or lowered relative to the front frame 104. Also, operation of the actuator 134 may cause the drawbar 120 and hence, the circle drive gear 136 to be tilted relative to the front frame 104 such that one end of the moldboard 140 is lower or higher than another end of the moldboard 140.

Figure 4:
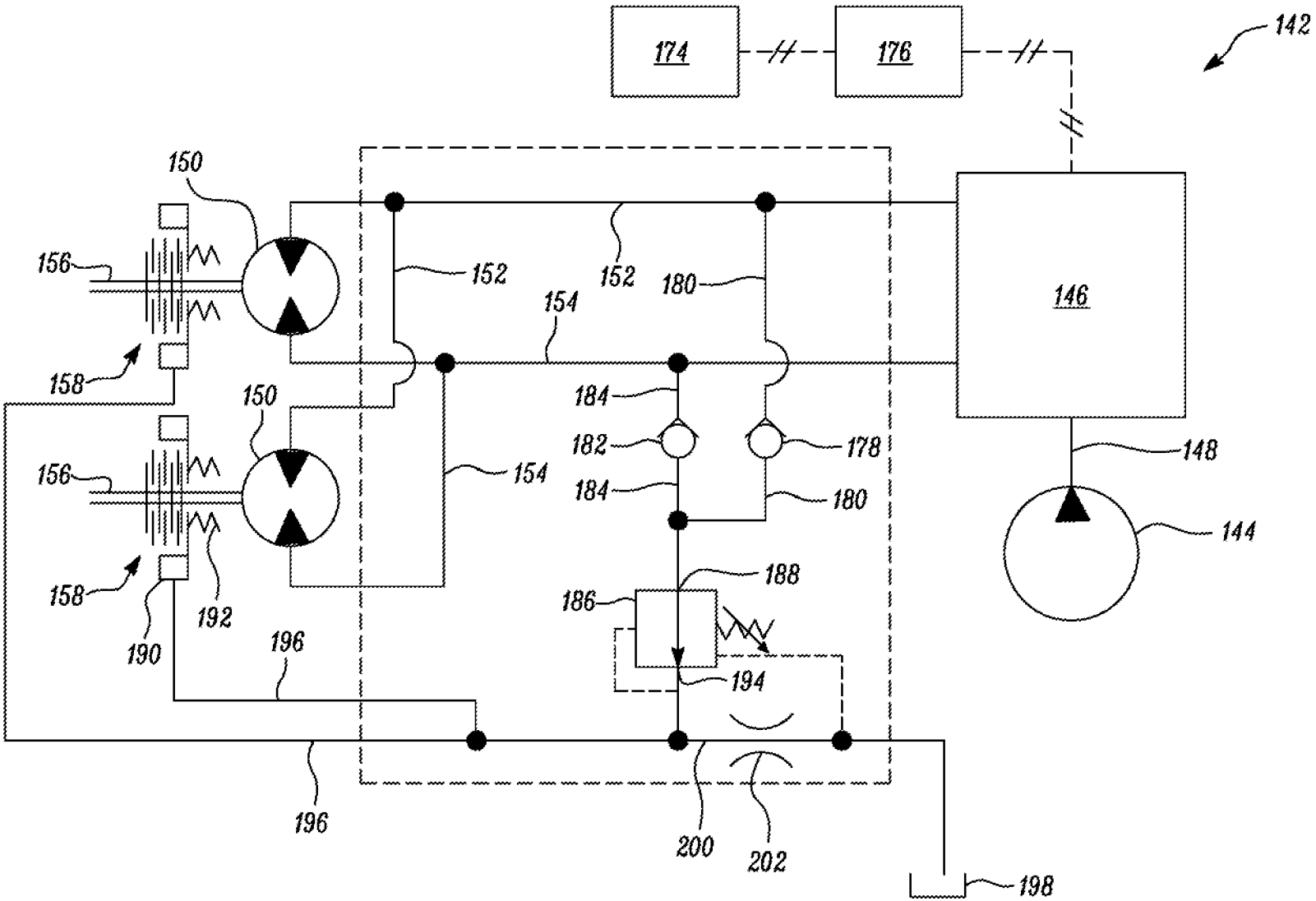
FIG. 4 is a schematic showing arrangement of components that form, at least in part, the system for operating the circle drive gear of the exemplary machine, in accordance with an embodiment of the present disclosure.

Referring to FIG. 4, the system 142 includes a pump 144. The pump 144 is configured to output pressurized fluid therefrom. In the illustrated embodiment of FIG. 4, the pump 144 is embodied as a fixed displacement pump. However, in other embodiments, the pump 144 may alternatively be embodied in the form of a variable displacement pump.

Further, as shown in FIG. 4, the system 142 also includes an implement control valve 146 fluidly coupled to the pump 144 via a supply line 148. In an exemplary embodiment as shown in FIG. 4, the implement control valve 146 is embodied as an electromechanically operated valve. However, in alternative embodiments, the implement control valve 146 may be embodied as a hydraulically operated valve in lieu of the electromechanically operated valve disclosed herein. Therefore, it may be noted that a type or configuration of the implement control valve 146 disclosed herein is merely exemplary in nature and hence, non-limiting of this disclosure. Rather, it will be appreciated by persons skilled in the art that the implement control valve 146 disclosed herein may be of any type or configuration that is suitable for performing functions consistent with the present disclosure.

Referring to FIG. 4, the system 142 also includes a pair of bi-directional hydraulic motors 150. Although two hydraulic motors 150 are shown in the illustrated embodiment of FIG. 4, it may be noted that such a tandem configuration of hydraulic motors is exemplary in nature and hence, non-limiting of this disclosure. In alternative embodiments, the system 142 may include fewer or more hydraulic motors than that disclosed herein depending on specific requirements of an application. For example, the system 142 may include one hydraulic motor in lieu of two hydraulic motors disclosed herein. To that end, the following disclosure is explained in conjunction with one of the hydraulic motors 150. However, it may be noted that similar explanation is applicable for the other hydraulic motor 150 shown in FIG. 4.

As shown in FIG. 4, the bi-directional hydraulic motor 150 is located downstream of the implement control valve 146. Moreover, the hydraulic motor 150 is fluidly coupled to the implement control valve 146 via a first delivery line 152 and a second delivery line 154. Referring to FIGS. 3 and 4, the hydraulic motor 150 has an output shaft 156 that is configured to be rotatively driven by pressurized fluid output by the pump 144 via the first and second delivery lines 152, 154.

Furthermore, the system 142 may also include a worm 160, and a pinion 162 as shown in FIG. 3. Referring to FIG. 3, the worm 160 is affixed to a free end 164 of the output shaft 156 and the pinion 162 is laterally disposed to the worm 160. A first gear (not shown) may be located at a first end of the pinion 162 and may be disposed in selective engagement with the worm 160 with the help of a clutch (not shown). Moreover, a second end 170 of the pinion 162 may be configured to bear a second gear (not shown) that may be adapted to operatively drive the circle drive gear 136 shown in FIG. 1.

Moreover, as shown schematically in FIG. 4, a brake 158 is disposed releasably on the output shaft 156 of the hydraulic motor 150. The brake 158 is configured to engage with the output shaft 156 with the help of a spring force for reducing a rotational speed of the output shaft 156 in a brake engage state, as will be explained later herein. Moreover, the brake 158 is also configured to operatively disengage with the output shaft 156 in a brake release state with the help of fluid pressure in at least one of the first delivery line 152 and the second delivery line 154, as will be explained later herein.

In an embodiment as shown in FIG. 4, the system 142 further includes a pair of one-way check valves 178, 182. A first one-way check valve 178 is disposed in a first branch line 180 that is configured to branch off from the first delivery line 152. A second one-way check valve 182 is disposed in a second branch line 184 that is configured to branch off from the second delivery line 154. The first and second branch lines 180, 184 are configured to extend past respective ones of the first and second one-way check valves 178, 182 and fluidly couple with an inlet port 188 of a pressure reducing valve 186 that is located downstream of the one-way check valves 178, 182.

Moreover, as shown in the illustrated embodiment of FIG. 4, the brake 158 further includes a brake piston 190 that is biased by a spring 192 into a brake engage position in which the brake 158 is engaged with the output shaft 156 of the hydraulic motor 150. Further, the brake piston 190 is disposed in fluid communication with an outlet port 194 of the pressure reducing valve 186 with the help of a brake control line 196. In response to fluid pressure in the brake control line 196 overcoming the bias associated with the spring 192, the brake piston 190 is moved into the brake release state in which the brake piston 190 is configured to operatively disengage the brake 158 from the output shaft 156.

Further, as shown, the system 142 also includes a tank 198 located downstream and fluidly coupled to the outlet port 194 of the pressure reducing valve 186 via a return line 200. The system 142 additionally includes an orifice 202 disposed in the return line 200. The pressure reducing valve 186 disclosed herein is a spring biased pilot operated valve that is set to open when a pressure of fluid in the brake control line 196 downstream of the pressure reducing valve 186 is less than or equal to a first predetermined value. Moreover, in embodiments of this disclosure, a size of the orifice 202 is selected to maintain a pressure in the brake control line 196 within a predetermined range of difference with respect to a pressure of fluid in the return line 200 downstream of the orifice 202.

Moreover, as shown schematically in the illustrated embodiment of FIG. 4, the system 142 additionally includes an input device 174, and a controller 176 that is communicably coupled to the input device 174 and the implement control valve 146. The input device 174 is configured to receive a command signal for rotating the output shaft 156 of the hydraulic motor 150. The controller 176 is configured to determine if the command signal for rotating the output shaft 156 has been received at the input device 174. In response to determining that the command signal for rotating the output shaft 156 has been received at the input device 174, the controller 176 is configured to actuate the implement control valve 146 such that the implement control valve 146 is configured to pressurize one of the first and second delivery lines 152, 154 for operatively releasing the brake 158 from the output shaft 156 of the hydraulic motor 150.

If the controller 176 determines that no command signal has been received at the input device 174 for rotating the output shaft 156 of the hydraulic motor 150, then the controller 176 is configured to actuate the implement control valve 146 such that the implement control valve 146 operatively de-pressurizes the first and second delivery lines 152, 154 to facilitate a closing of the pressure reducing valve 186 when the pressure of fluid in the brake control line 196 downstream of the pressure reducing valve 186 is greater than the first predetermined value, and allow the brake 158 to engage with the output shaft 156 of the hydraulic motor 150 for providing a holding torque to the output shaft 156 of the hydraulic motor 150.

In embodiments herein, it may be noted that a size of the orifice 202 is selected to maintain a pressure in the brake control line 196 to lie within a predetermined range of difference with respect to a pressure of fluid in the return line 200 downstream of the orifice 202. This way, the orifice 202 ensures that a large amount of fluid does not flow past the orifice 202 towards the tank 198 and hence, an adequate amount of fluid pressure is always present in the brake control line 196 to accomplish subsequent applications of the brake 158 onto the output shaft 156 of the hydraulic motor 150.

Figure 5:
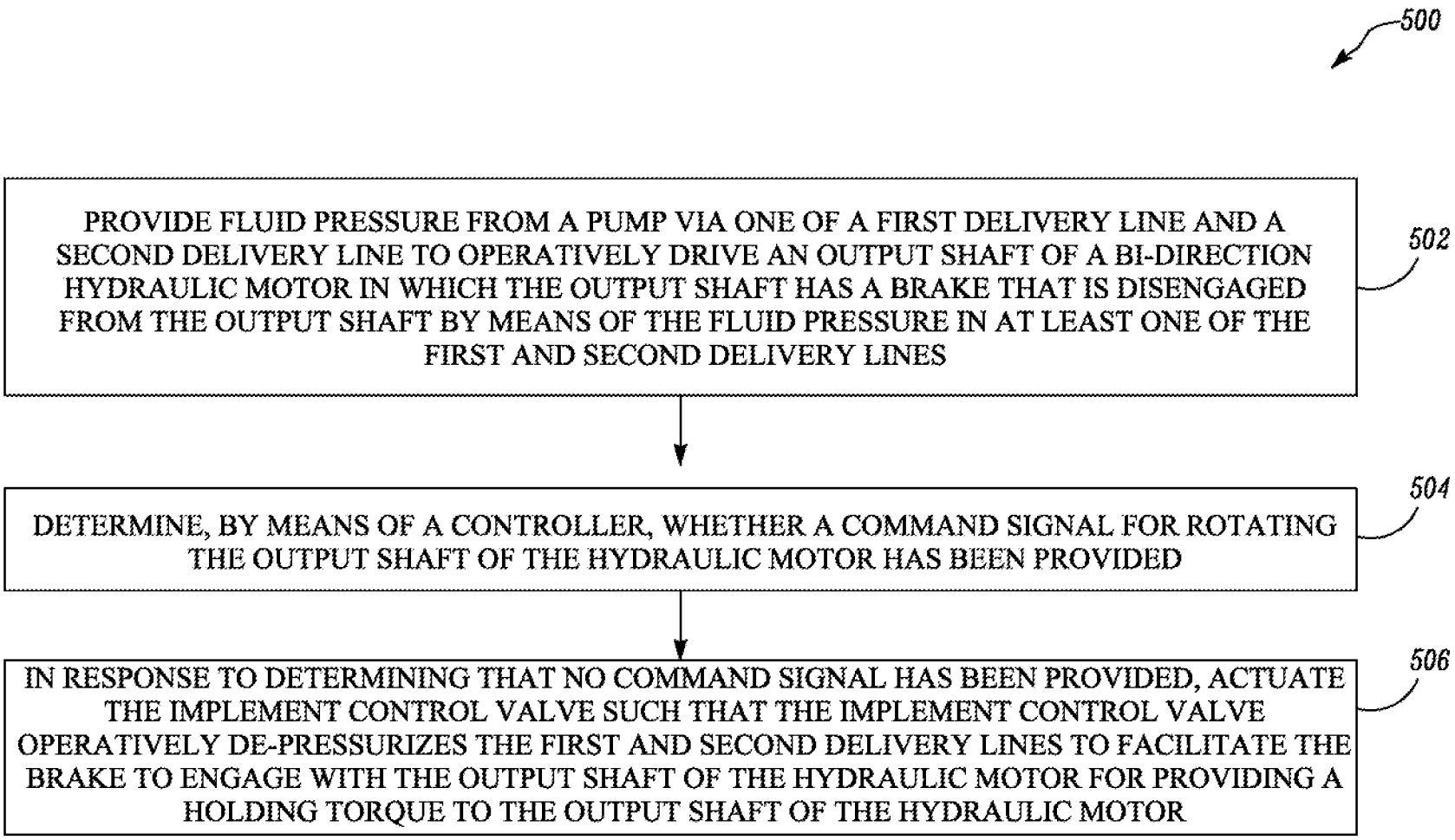
FIG. 5 is a flowchart depicting a method for operating the circle drive gear of the exemplary machine, in accordance with an embodiment of the present disclosure.

FIG. 5 illustrates a method 500 for operating the circle drive gear 136 of the exemplary machine 100, in accordance with an embodiment of the present disclosure. As shown at step 502 of the method 500 in FIG. 5, the method 500 includes providing fluid pressure from the pump 144 via one of the first and second delivery lines 152, 154 to operatively drive the output shaft 156 of the hydraulic motor 150 in which the output shaft 156 has a brake 158 that has been disengaged from the output shaft 156 by means of the fluid pressure in at least one of the first and second delivery lines 152, 154.

At step 504, the method 500 includes determining, by means of the controller 176, whether a command signal for rotating the output shaft 156 of the hydraulic motor 150 has been provided. At step 506, the method 500, in response to determining that no command signal has been provided at the input device 174, further includes actuating the implement control valve 146, by means of the controller 176, such that the implement control valve 146 operatively de-pressurizes the first and second delivery lines 152, 154 to facilitate the brake 158 to engage with the output shaft 156 of the hydraulic motor 150 for providing a holding torque to the output shaft 156 of the hydraulic motor 150.

INDUSTRIAL APPLICABILITY

Previously known circle drive systems were typically formed using mechanical components that could allow forces from the moldboard of an earthmoving machine to be transmitted into a hydraulic circuit that is configured to operatively drive the mechanical components. Consequently, in some cases, if the amount of forces encountered by the moldboard were large, such large amount of forces may have the ability to potentially cause a failure of components associated with the mechanical components that may or may not form part of the hydraulic circuit. For example, if the magnitude of an impact force encountered by the moldboard is greater than an amount of torque associated with an output shaft of the hydraulic motor, then the output shaft may fail leading to a loss of further transmission of power from the hydraulic motor to the moldboard for performing subsequent operations.

With use of the system disclosed herein, the brakes are spring biased into engagement with the output shaft of the hydraulic motor and released from engagement in response to a pressure of fluid in the first and second delivery lines. By allowing the brakes to engage with the output shaft of the motor, an amount of resistive torque on the output shaft of the hydraulic motor may be increased so that failure of one or more components associated with the hydraulic motor may be prevented. Therefore, with implementation of the system disclosed herein, manufacturers of circle drive systems using hydraulic motors can improve a reliability of components in use and reduce downtimes that were typically incurred from failure of components in previously known configurations of circle drive systems. Consequently, with use of the system disclosed herein, users of earthmoving machines such as motor graders may be able to offset costs, time, and effort that was previously associated with replacement and repair of failed components.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to tall within the scope of the present disclosure as determined based upon the claims and any equivalents thereof.

What is claimed is:

1. A system for operating a circle drive gear of a machine, the system comprising:

a pump configured to output pressurized fluid therefrom;

an implement control valve fluidly coupled to the pump via a supply line;

a bi-directional hydraulic motor located downstream of the implement control valve and fluidly coupled to the implement control valve via a first delivery line and a second delivery line, the hydraulic motor having an output shaft associated therewith, the output shaft configured to be rotatively driven by pressurized fluid output by the pump; and a brake disposed on the output shaft of the hydraulic motor, the brake configured to:

engage with the output shaft with the help of a spring force for reducing a rotational speed of the output shaft in a brake engage state; and operatively disengage from the output shaft in a brake release state with the help of fluid pressure in at least one of the first delivery line and the second delivery line.

2. The system of claim 1 further comprising a one-way check valve disposed in each of a first branch line and a second branch line that are configured to branch off from respective ones of the first delivery line and the second delivery line, wherein each of the first branch line and the second branch line are fluidly coupled to an inlet port of a pressure reducing valve downstream of the pair of one-way check valves.

3. The system of claim 2, wherein the brake includes a brake piston that is disposed in fluid communication with an outlet port of the pressure reducing valve with the help of a brake control line, the brake piston configured to operatively disengage from the output shaft in the brake release state with the help of fluid pressure in the brake control line.

4. The system of claim 3 further comprising:

a tank located downstream and fluidly coupled to the outlet port of the pressure reducing valve via a return line, and an orifice disposed in the return line.

5. The system of claim 4, wherein the pressure reducing valve is a spring biased pilot operated valve set to open when a pressure of fluid in the brake control line downstream of the pressure reducing valve is less than or equal to a first predetermined value.

6. The system of claim 5, wherein a size of the orifice is selected to maintain a pressure in the brake control line to lie within a predetermined range of difference with respect to a pressure of fluid in the return line downstream of the orifice.

7. The system of claim 6 further comprising:

an input device configured to receive a command signal for rotating the output shaft of the hydraulic motor; and a controller communicably coupled to the input device and the implement control valve, the controller configured to:

determine if the command signal for rotating the output shaft has been received at the input device, and in response to the determination, actuate the implement control valve such that the implement control valve is configured to pressurize one of the first and second delivery lines for operatively releasing the brake.

8. The system of claim 7, wherein if the controller determines that no command signal has been received at the input device for rotating the output shaft of the hydraulic motor, then the controller is configured to:

actuate the implement control valve such that the implement control valve operatively de-pressurizes the first and second delivery lines to facilitate a closing of the pressure reducing valve when the pressure of fluid in the brake control line downstream of the pressure reducing valve is greater than the first predetermined value; and allow the brake to engage with the output shaft of the hydraulic motor for providing a holding torque to the output shaft of the hydraulic motor.

9. A machine comprising:

a moldboard;

a circle drive gear coupled to the moldboard;

a pump configured to output pressurized fluid therefrom;

an implement control valve fluidly coupled to the pump via a supply line;

a bi-directional hydraulic motor located downstream of the implement control valve and fluidly coupled to the implement control valve via a first delivery line and a second delivery line, the hydraulic motor having an output shaft associated therewith, the output shaft of the hydraulic motor being configured to be rotatively driven by pressurized fluid output by the pump for rotating the circle drive gear; and a brake disposed on the output shaft of the hydraulic motor, the brake configured to:

engage with the output shaft with the help of a spring force for reducing a rotational speed of the output shaft in a brake engage state; and operatively disengage from the output shaft in a brake release state with the help of fluid pressure in at least one of the first delivery line and the second delivery line.

10. The machine of claim 9 further comprising a one-way check valve disposed in each of a first branch line and a second branch line that are configured to branch off from respective ones of the first delivery line and the second delivery line, wherein each of the first branch line and the second branch line are fluidly coupled to an inlet port of a pressure reducing valve downstream of the pair of one-way check valves.

11. The machine of claim 10, wherein the brake includes a brake piston that is disposed in fluid communication with an outlet port of the pressure reducing valve with the help of a brake control line, the brake piston configured to operatively disengage from the output shaft in the brake release state with the help of fluid pressure in the brake control line.

12. The machine of claim 11 further comprising:

a tank located downstream and fluidly coupled to the outlet port of the pressure reducing valve via a return line, and an orifice disposed in the return line.

13. The machine of claim 12, wherein the pressure reducing valve is a spring biased pilot operated valve set to open when a pressure of fluid in the brake control line downstream of the pressure reducing valve is less than or equal to a first predetermined value.

14. The machine of claim 13, wherein a size of the orifice is selected to maintain a pressure in the brake control line to lie within a predetermined range of difference with respect to a pressure of fluid in the return line downstream of the orifice.

15. The machine of claim 14 further comprising:

an input device configured to receive a command signal for rotating the output shaft of the hydraulic motor; and a controller communicably coupled to the input device and the implement control valve, the controller configured to:

determine if the command signal for rotating the output shaft has been received at the input device, and in response to the determination, actuate the implement control valve such that the implement control valve is configured to pressurize one of the first and second delivery lines for operatively releasing the brake.

16. The machine of claim 15, wherein if the controller determines that no command signal has been received at the input device for rotating the output shaft of the hydraulic motor, then the controller is configured to:

actuate the implement control valve such that the implement control valve operatively de-pressurizes the first and second delivery lines to facilitate a closing of the pressure reducing valve when the pressure of fluid in the brake control line downstream of the pressure reducing valve is greater than the first predetermined value; and allow the brake to engage with the output shaft of the hydraulic motor for providing a holding torque to the output shaft of the hydraulic motor.

17. A method for operating a circle drive gear associated with a moldboard of a machine, the method comprising:

providing fluid pressure from a pump via one of a first delivery line and a second delivery line to operatively drive an output shaft of a bi-directional hydraulic motor, wherein the output shaft has a brake associated therewith, the brake being disengaged from the output shaft by means of the fluid pressure in at least one of the first and second delivery lines;

determining, by means of a controller, whether a command signal for rotating the output shaft of the hydraulic motor has been provided; and in response to determining that no command signal has been provided, actuate the implement control valve, by means of the controller, such that the implement control valve operatively de-pressurizes the first and second delivery lines to facilitate the brake to engage with the output shaft of the hydraulic motor for providing a holding torque to the output shaft of the hydraulic motor.

18. The method of claim 17, wherein in response to determining that the command signal has been provided, actuating the implement control valve, by means of the controller, such that the implement control valve pressurizes the first and second delivery lines to facilitate the brake to disengage from the output shaft of the hydraulic motor.

* * * * *